US005436714A

United States Patent [19]

Suzuki

[11] Patent Number: 5,436,714

[45] Date of Patent: Jul. 25, 1995

[54] ELECTROPHOTOGRAPHIC APPARATUS HAVING A CLEANING DEVICE

[75] Inventor: Eiji Suzuki, Kawasaki, Japan

[73] Assignee: Fujitsu Limited, Kawasaki, Japan

[21] Appl. No.: 235,793

[22] Filed: Apr. 29, 1994

[30] Foreign Application Priority Data

Jul. 22, 1993 [JP] Japan ..... 5-180981

[51] Int. Cl.[6] ..... G03G 21/00

[52] U.S. Cl. ..... 355/301; 15/179; 15/256.52; 15/DIG. 6

[58] Field of Search ..... 355/301, 296, 297; 15/179, DIG. 6, 256.52, DIG. 5

[56] References Cited

U.S. PATENT DOCUMENTS

| | | | |
|---|---|---|---|
| 4,319,831 | 3/1982 | Matsui et al. | 355/303 |
| 4,673,284 | 6/1987 | Matsumoto et al. | 355/301 |
| 4,706,320 | 11/1987 | Swift | 15/256.52 X |
| 4,835,807 | 6/1989 | Swift | 15/179 X |
| 5,126,796 | 6/1992 | Fujii et al. | 355/271 |

FOREIGN PATENT DOCUMENTS

| | | | |
|---|---|---|---|
| 60-49380 | 3/1985 | Japan | 355/301 |
| 3-77989 | 4/1991 | Japan | 355/301 |
| 4-195080 | 7/1992 | Japan . | |
| 4-238383 | 8/1992 | Japan | 355/301 |
| 5-53486 | 3/1993 | Japan | 355/301 |
| 5-80682 | 4/1993 | Japan . | |

*Primary Examiner*—A. T. Grimley
*Assistant Examiner*—Nestor R. Ramirez
*Attorney, Agent, or Firm*—Armstrong, Westerman, Hattori, McLeland & Naughton

[57] ABSTRACT

In an image formation apparatus such as an electrophotographic printing apparatus, a cleaning device can effectively clean the peripheral surface of a photosensitive drum throughout the full length. The cleaning apparatus includes a fur brush 32 rotating while keeping contact with the entire periphery of a photosensitive drum 6. The cleaning characteristics of this fur brush 32 change between an outside portion R opposing gap roller contact portions at both end portions outside a print area of the photosensitive drum 6 and an inside portion inside this outside portion R.

18 Claims, 9 Drawing Sheets

ELECTROPHOTOGRAPHIC APPARATUS HAVING A CLEANING DEVICE

BACKGROUND OF THE INVENTION

1. Field of the Invention

This invention relates to an electrophotographic apparatus having a cleaning device used for an image formation apparatus such as a printing apparatus using an electrophotographic system.

2. Description of the Related Art

In a conventional printing apparatus using an electrophotographic system, a cleaning system using a rubber blade, a fur brush, or the like, has gained wide acceptance for cleaning untransferred residual toner adhering to a photosensitive drum after transfer. A system using a rubber blade and a fur brush in combination has also been employed. Particularly, a fur brush cleaning system has been often used for high speed machines, and the residual toner on the photosensitive drum, which has not been transferred to a recording sheet, is removed by the fur brush.

A cleaning fleece or blade has also been used to clean any contamination which has not been removed by the fur brush.

In the printing apparatus of this kind, a gap producing roller for defining a gap between an exposure portion (using an LED array) for forming an electrostatic latent image and the peripheral surface of the photosensitive drum, and a gap producing roller for defining a gap between the peripheral surface of the photosensitive drum and a sheet entry guide at a transfer portion are arranged to rotate while maintaining contact with the peripheral surface of the photosensitive drum outside the print area.

A film-like toner adheres to the peripheral surface at the end portions of the photosensitive drum, where the gap producing rollers keep contact, due to scattering toner during printing. This portion is also cleaned, with the print area portion of the photosensitive drum, by a combination of the fur brush cleaner with a cleaning fleece or a combination of the fur brush cleaner with a cleaning blade.

In the case of the former combination, i.e. the fur brush cleaner with the cleaning fleece, the cleaning fleece portion corresponding to both end portions of the photosensitive drum, to which the film-like toner adheres, is made coarser than usual so as to improve the cleaning effect, but scratch and wear occur on the peripheral surface of the photosensitive drum. In the case of the latter combination, a push force of the blade can be changed, but flattering and feeding failure of the sheet may occur. Further, the cleaning effect drops at the portion where the amount of the toner is great, such as the gap producing roller contact portions, because adhesion of the toner to the blade is strong.

As described above, since the conventional cleaning system cannot effectively clean the film-like toner adhering to the peripheral surface of the photosensitive drum, with which the gap producing rollers are in contact, the following problems occur.

(1) The original gap cannot be secured.

(2) When a large amount of the toner adheres to the drum, the toner may peel off at the contact portion with the gap producing rollers, may contaminate the peripheral portions, and may exert an adverse influence on printing.

SUMMARY OF THE INVENTION

It is therefore an object of the present invention to provide an electrophotographic apparatus having a cleaning device which can effectively clean the peripheral surface of a photosensitive drum throughout its full length.

According to the present invention, there is provided an electrophotographic printing apparatus having a cleaning device comprising: a rotatable photosensitive drum having an outer circumferential surface having, along an axial direction thereof, an inside area including at least a printing area and respective outside areas positioned outward of said inside area in an axial direction thereof; a rotatable fur brush being in contact with said outer surface of the photosensitive drum entirely in the axial direction of said drum; and said fur brush having, along its axial direction, an inner area opposite to said inside area of the drum and respective outer areas opposite to said respective outside areas of the drum, and the cleaning characteristic of the fur brush in said inner area is different from that in said respective outer areas.

It is advantageous that said rotatable fur brush comprises a cylindrical substrate and hairs or fibers implanted on said cylindrical substrate, the hardness of the fibers implanted in said outer areas is greater than the hardness of the fibers implanted in said inner area of the fur brush.

It is also advantageous that said rotatable fur brush comprises a cylindrical substrate and hairs of fibers implanted on said cylindrical substrate, a density or fibers implanted in said outer areas is greater than a density of fibers implanted in said inner area of the fur brush.

It is further advantageous that said rotatable fur brush comprises a cylindrical substrate and hairs or fibers implanted on said cylindrical substrate, the hardness of fibers implanted in a part of said outer areas is greater than the hardness of fibers implanted in said inner area of the fur brush and the density of fibers implanted in the remaining part of said outer areas is greater than the density of fibers implanted in said inner area of the fur brush.

Thus, according to the present invention, since the cleaning characteristic of fur brush in the inner area thereof is different from that in said respective outer areas, i.e., the outside areas of the photosensitive drum, to which toner may more readily adhered as mentioned above, can be more strongly cleaned than the inside area of the drum. Therefore, a variation of gap clearance between the drum and the LED array or the like will no longer occur and no toner will be scattered from the drum.

DESCRIPTION OF THE PREFERRED EMBODIMENTS

Hereinafter, preferred embodiments of the present invention will be described with reference to the accompanying drawings.

Figure 1:
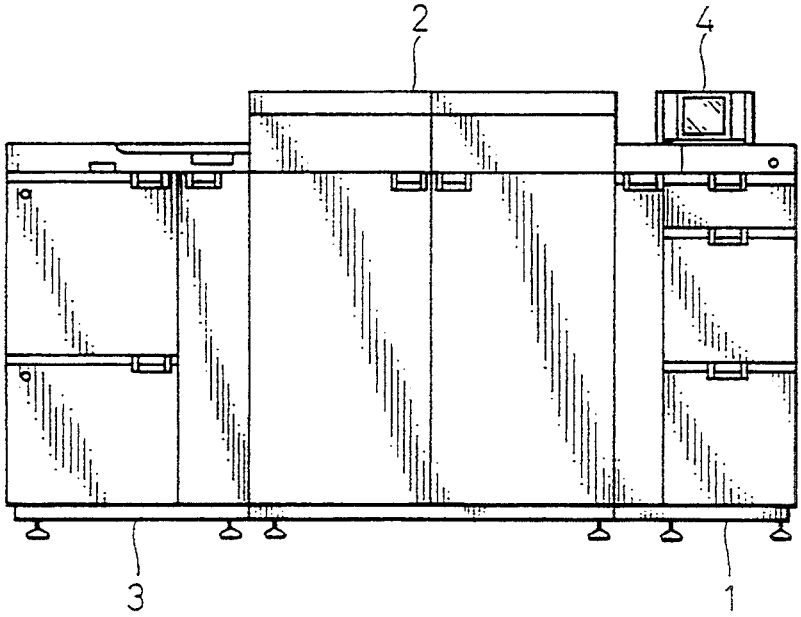
FIG. 1 is a schematic view showing the appearance of an electrophotographic printing apparatus according to the present invention.
Figure 2:
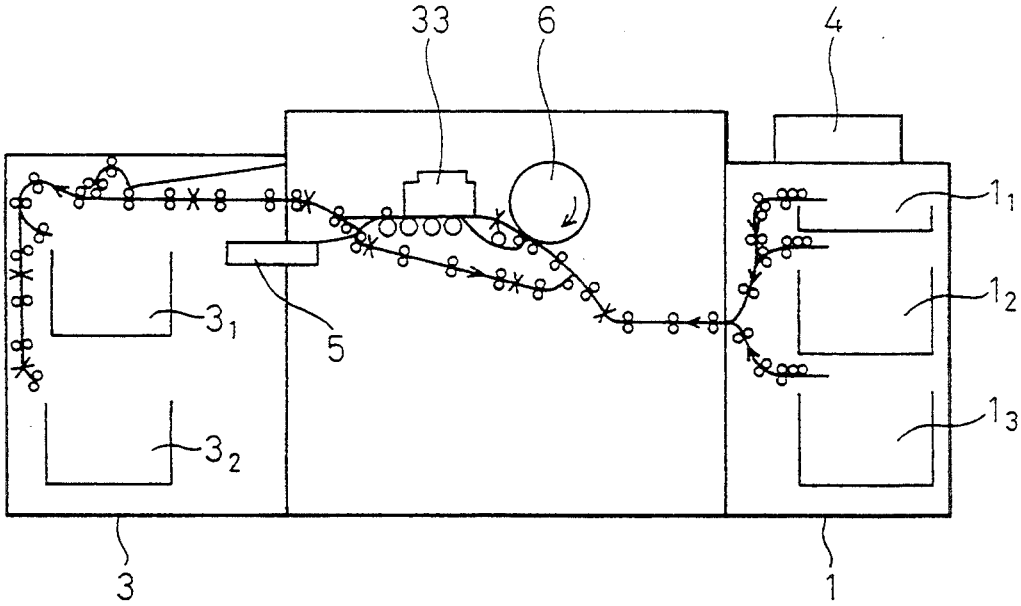
FIG. 2 is an explanatory view showing an internal conveying path of the electrophotographic printing apparatus shown in FIG. 1.

FIG. 1 shows the appearance of an electrophotographic printing apparatus to which the present invention is applied, and FIG. 2 is an explanatory view showing an internal conveying path. In the drawings, reference numeral 1 denotes a hopper portion, 2 is a printer portion, 3 is a stacker portion, and 4 is an operation display portion. Hoppers $1_1$, $1_2$ and $1_3$ are disposed at upper, intermediate and lower stages inside the hopper portion 1, respectively, and stackers $3_1$ and $3_2$ are vertically disposed in the stacker portion 3. Reference, numeral 5 in FIG. 2 denotes a reversible conveyor portion (the operation of which will be later described).

Figure 3:
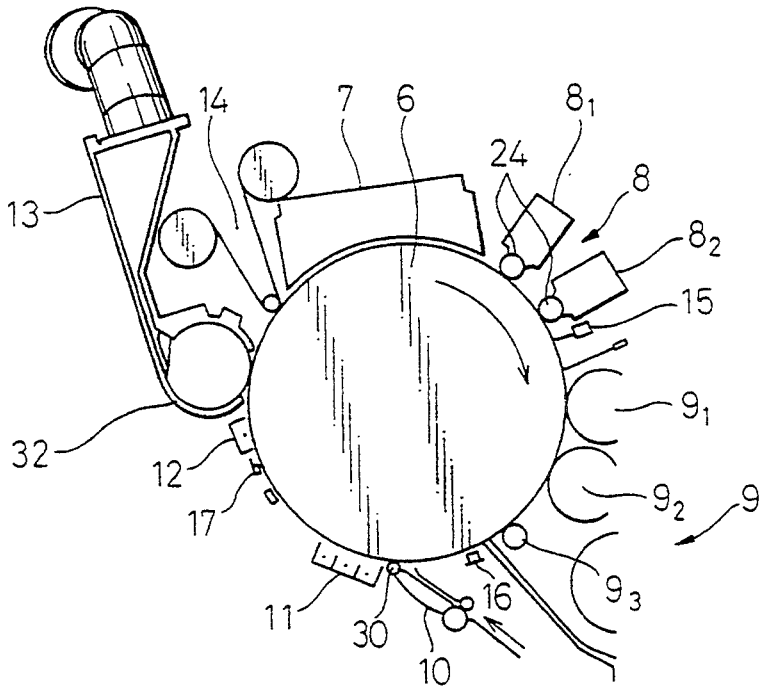
FIG. 3 is a structural explanatory view of a printer portion of the electrophotographic printing apparatus shown in FIG. 1.

As shown in detail in FIG. 3, the printer portion 2 includes a photosensitive drum 6, a pre-charging device 7, an exposure portion 8, a developing unit 9, a sheet entry guide 10, a transfer charging device 11, an AC charge eliminator 12, a surface potential sensor 15, a pre-transfer charge eliminator 16 and an LED charge eliminator 17 that are disposed around the photosensitive drum 6.

Figure 4:
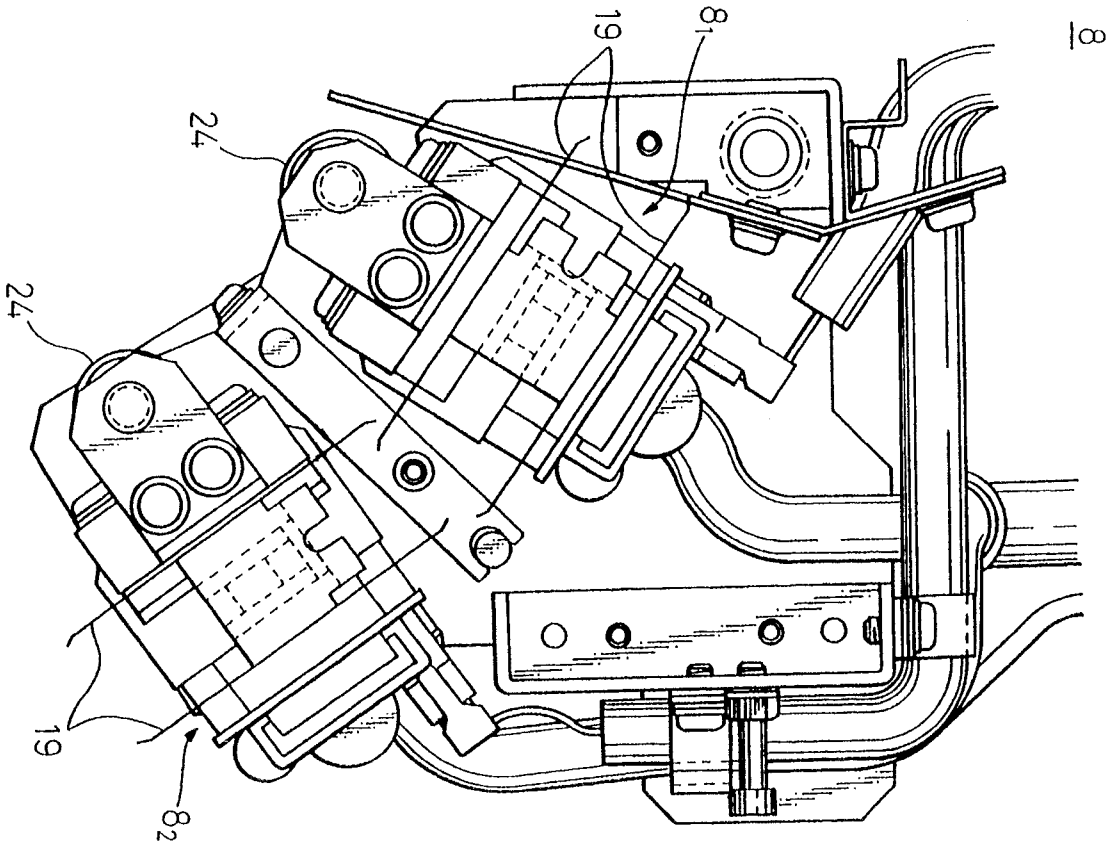
FIG. 4 is a side view showing a detailed structure of an exposure portion of FIG. 3.
Figure 5A:
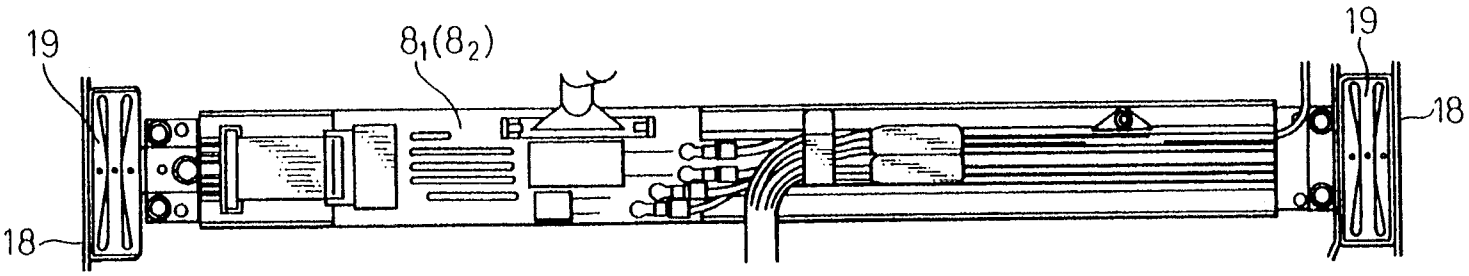
FIGS. 5A and 5B are explanatory views of a fitting structure of an LED array of FIG. 4, wherein (A) is a plan view and (B) is a front view.
Figure 5B:
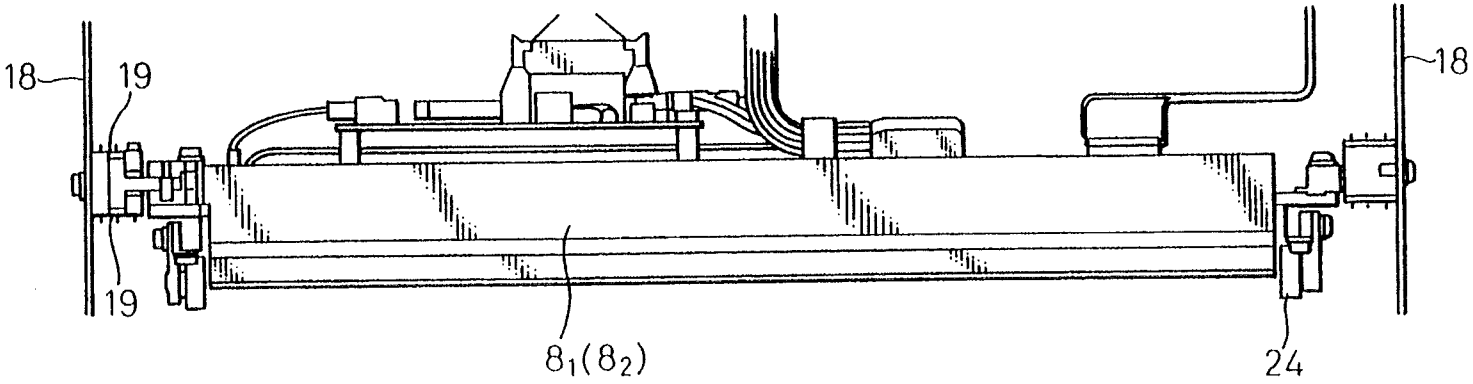
Figure 6A:
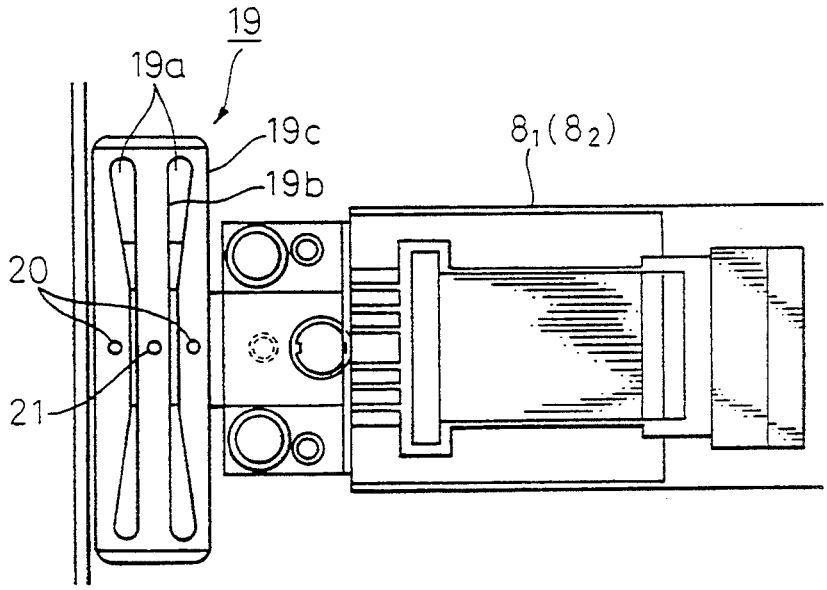
FIGS. 6A and 6B are enlarged views of principal portions of FIG. 5, wherein (A) is a plan view and (B) is a front view.
Figure 6B:
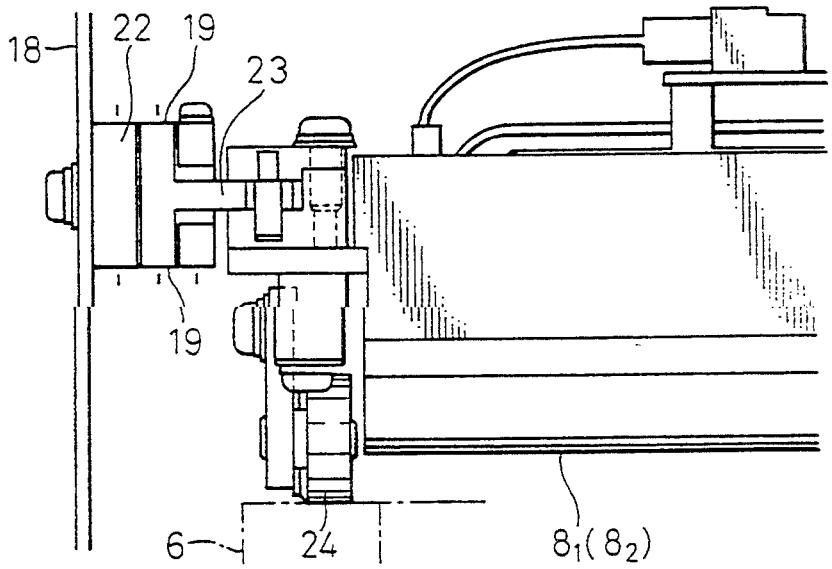

As shown in detail in FIG. 4, the exposure portion 8 is constituted by juxtaposing an LED array $8_1$ of 240 dpi and an LED array $8_2$ of 300 dpi. FIG. 5A is a plan view of the fitting structure of the LED array $8_1$ ($8_2$) and FIG. 5B is a front view thereof. FIG. 6A is an enlarged plan view of the principal portions of FIGS. 5A and 5B and FIG. 6B is a front view thereof. The LED array $8_1$ ($8_2$) is supported by a frame 18 of the exposure portion 8 through a pair of leaf springs 19. Both of the upper and lower leaf springs 19 are made of the same material. Each leaf spring 19 is equipped with a slit 19*a*, and an intermediate leaf portion 19*b* is so formed as to be capable of displacement with respect to an outer frame portion 19*c*. Reference numeral 20 denotes a hole for a screw which fixes the outer frame portion 19*c* of the leaf spring 19 to a block 22 on the side of the frame 18. Reference numeral 21 denotes a hole for a screw which fixes the intermediate portion 19*b* of the leaf spring 19 to a block 23 on the side of the LED array $8_1$ ($8_1$).

Figure 7A:
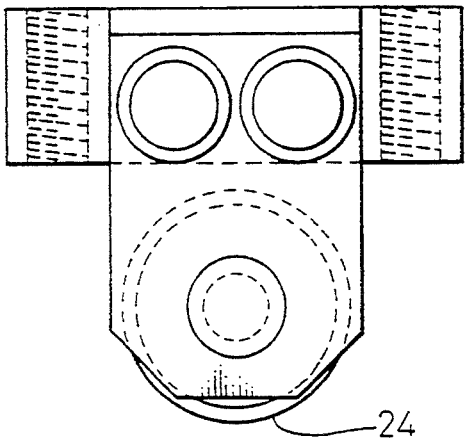
FIGS. 7A and 7B are detailed views of a support portion of a gap producing roller, wherein (A) is a side view and (B) is a front view.
Figure 7B:
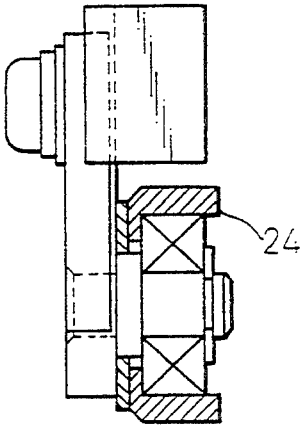

A pair of gap producing rollers 24, which come into contact with portions other than print area at both end portions of the photosensitive drum 6, are rotatably supported by the LED array $8_1$ ($8_2$), as shown in FIG. 6B. The contact force of the gap producing rollers 24 to the photosensitive drum 6 is imparted by the leaf springs 19. Accordingly, even when any eccentricity resulting from accuracy of components occurs in the photosensitive drum 6, this eccentricity is absorbed by the leaf springs 19, and the gap between the LED array and the surface of the photosensitive drum 6 is kept constant. FIG. 7A is a detailed side view of the support portion of the gap producing roller 24 and FIG. 7B is a front view thereof.

Figure 8:
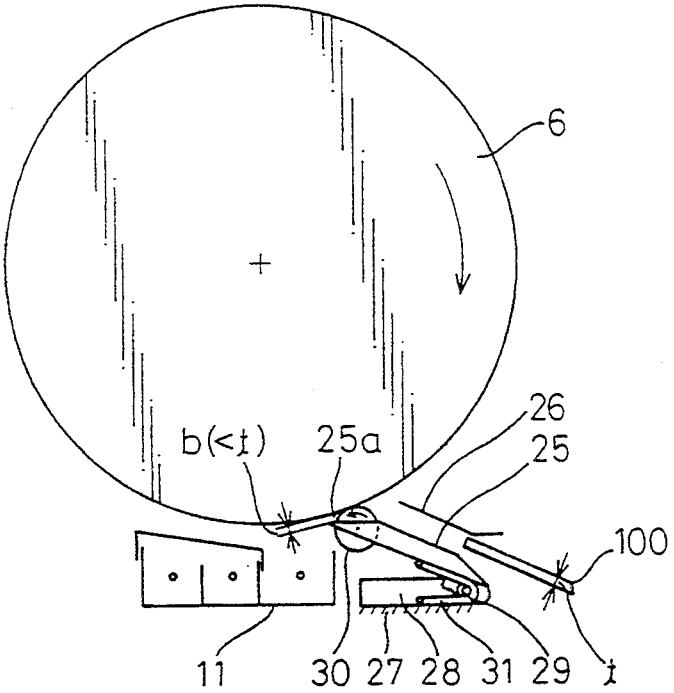
FIG. 8 is a side view showing a detailed structure of a sheet entry guide of FIG. 3.

As shown in detail in FIG. 8, the sheet entry guide 10 is equipped with a lower conveyor guide 25 and an upper conveyor guide 26 opposing the former. These conveyor guides 25 and 26 have a width somewhat greater than the width of a sheet so as to completely guide the sheet 100 conveyed to a transfer position, and are formed by a rigid plate such as a stainless steel. However, only the distal end portion 25*a* of the lower conveyor guide 25 made of a material having flexibility and higher stiffness than paper, such as a metal or a resin, such as a plastic sheet.

Figure 9:
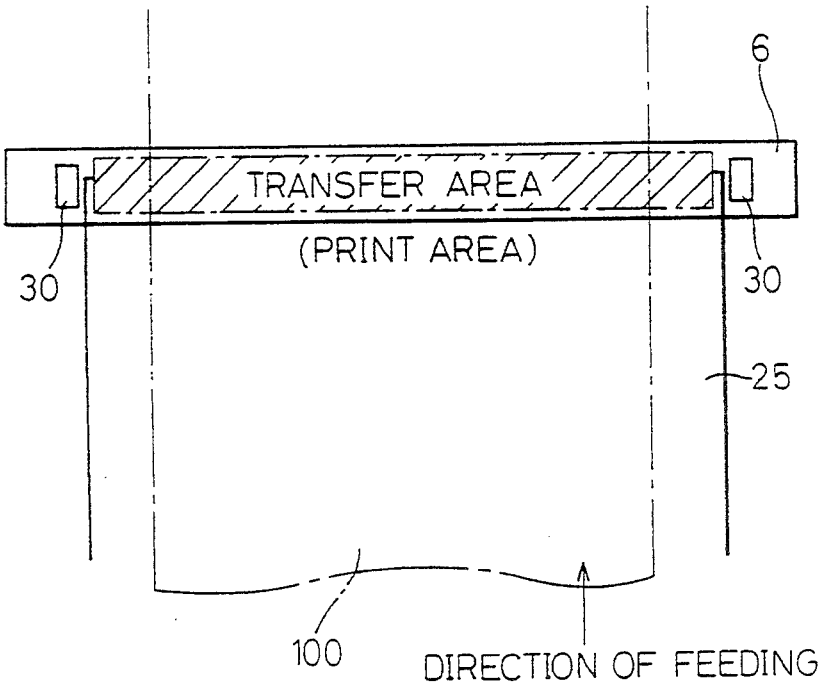
FIG. 9 is an explanatory view of the positions of the gap producing rollers shown in FIG. 8 and a photosensitive drum in a longitudinal direction.

The base portion of the lower conveyor guide 25 is rotatably supported by a shaft 29 which is in turn supported by a side plate 28 of a fixed portion 27. A pair of gap producing rollers 30 are rotatably supported in the proximity of the distal end of the lower conveyor guide 25. The gap producing rollers 30 exist in the proximity of the right end of the transfer charger 11. The lower conveyor guide 25 is biased clockwise by a coil spring 31 wound on a shaft 29, so that the gap producing rollers 30 are brought into pressure contact with the photosensitive drum 6. FIG. 9 is an explanatory view of the relationship between the gap producing rollers 30 and the photosensitive drum 6 in the longitudinal direction.

A gap b is defined between the distal end portion 25*a* of the lower conveyor guide 25 and the photosensitive drum 6, and the size of this gap is smaller than the thickness t of a recording medium 100. Accordingly, when the leading edge of the recording paper 100 entering the gap between the lower and upper conveyor guides 25, 26 and conveyed to the transfer position reaches the gap producing roller 30, the recording paper 100 pushes down the gap producing roller 30 against the force of the coil spring 31. The paper 100 is clamped between the photosensitive drum 6 and the gap producing roller 30 and is conveyed forward.

Vibration occurring due to eccentricity of the photosensitive drum 6 during this conveying operation is absorbed by the coil spring 31. The recording paper 100 is pushed to the surface of the photosensitive drum 6 by the gap producing roller 30 when it passes the roller 30 and is in close contact with the surface of the photosensitive drum 6. Moreover, since this close contact portion exists in the proximity of the transfer position, the occurrence of print fall-off and print non-uniformity (which becomes a problem particularly in the case of double-face printing) can be prevented when the toner image is transferred from the surface of the photosensitive drum to the sheet 100.

The cleaning device 13 is equipped with a fur brush 32 (see FIG. 3) which rotates while keeping contact with the photosensitive drum 6 throughout the entire length of the latter.

When printing is made, the photosensitive drum 6 is turned clockwise as represented by arrows in FIGS. 2 and 3. The surface of the drum 6 is uniformly charged by the pre-charger 7. Next, exposure of the surface is effected by the exposure portion 8 in the pattern corresponding to the data, thereby forming an electrostatic latent image on the drum 6. This electrostatic latent image is developed to a toner image by the developing unit 9. Reference numerals $9_1$, $9_2$ and $9_3$ in FIG. 3 denote a first development magnetic roller, a second development magnet roller and a recovery magnet roller disposed in the developing unit 9, respectively.

On the other hand, the sheet 100 is delivered from a predetermined hopper of the hopper portion 1 and is sent to the transfer position while being guided by the sheet entry guide 10. The toner image on the photosensitive drum 6 is transferred to the sheet 100 by the transfer charger 11 opposing the photosensitive drum 6 through the sheet. Thereafter, the image is fixed to the sheet 100 by the fixing device 33 (see FIG. 2). In the case of one-side printing, the sheet after fixation is discharged into any of the stackers $3_1$, $3_2$ of the stacker portion 3.

In the case of double-side printing, the conveyor path is changed and the sheet after completion of fixation of one side is sent to the reversal transfer portion 5, and is thereafter conveyed to the photosensitive drum 6 while its front and back are reversed. Printing is then made to the back in the same way as printing of the front surface, and the sheet is discharged into the stacker portion 3 after the toner image on the back is fixed.

Symbol × in FIG. 2 represents a sheet sensor and symbol ∘ represents a conveyor roller. The sheet sensor measures the timing of the sheet being conveyed to form the latent image or the visible image on the photosensitive drum 6, and detects any abnormality of the passage of the sheet. This abnormality of sheet passage is displayed in the operation display portion 4, so that an operator watches this display to take necessary measures.

Any residual charge on the surface of the photosensitive drum 6 is removed by the LED charge eliminator 17 and the AC charge eliminator 12. The surface of the drum 6 is cleaned by the fur brush 32 of the cleaning device 13. A cleaning fleece 14 periodically cleans the surface of the photosensitive drum 6. Thereafter, printing operations described above are repeated.

Figure 10:
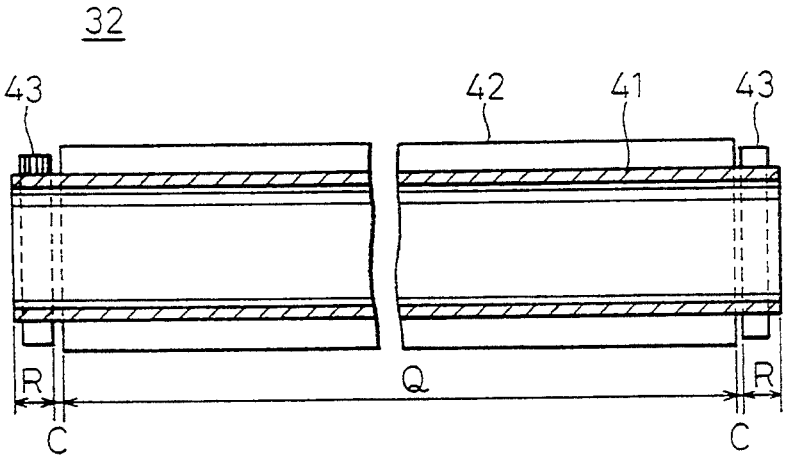
FIG. 10 is a front view of a fur brush according to an embodiment of the present invention.

FIG. 10 shows the structure of the fur brush 32 for cleaning the surface of the photosensitive drum after transfer as described above. The fur brush 32 is produced by bonding a brush 42 and brushes 43, 43 to the surface of a cylindrical substrate 41. The brush 42 is bonded to an inside portion Q of a range greater than the print area, and the brushes 43 are bonded to outside portions R outside the inside portion Q. A gap C of 3 to 5 mm exists between the brush 42 and the brushes 43. Each brush is formed by implanting fibers of nylon, rayon, etc, to a tape substrate.

Figure 11:
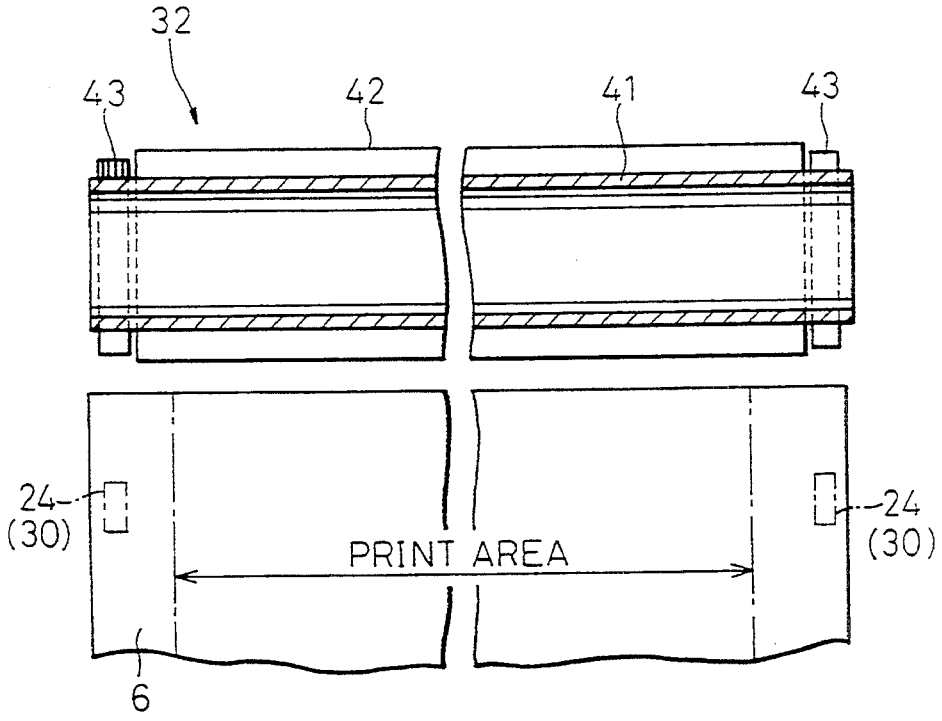
FIG. 11 is an explanatory view showing a relative position between the fur brush of FIG. 10 and a photosensitive drum in a longitudinal direction.

The relative positions of the fur brush 32 and the photosensitive drum 6 in the longitudinal direction are set as shown in FIG. 11. The brushes 43 oppose the gap producing rollers 24, 30 which come into contact with the photosensitive drum 6 at both end portions outside the print area.

In the present invention, the cleaning characteristics of the fur brushes are changed between the outside portion R and the inside portion Q so as to obviate the problems with the prior art already described. More definitely, any one of the following three constructions will be effective.

(1) The fibers of the outside portion R of the fur brush 32 are made harder by at least 10% than the fibers of the inside portion Q. Methods of making the fibers harder include ① the use of fibers having higher hardness, ② the use of thick fibers, ③ the use of short fibers, and so forth.

(2) The density of the fibers of the outside portion R of the fur brush 32 is made higher by at least 10% than the density of the fibers of the inside portion Q.

(3) The hardness of a part of the fibers of the outside portion R of the fur brush 32 is made higher by at least 10% than that of the fibers of the inside portion Q, and the density of the remaining fibers of the outside portion R is made higher by at least 10% than that of the fibers of the inside portion Q.

In any of the constructions described above, the brush 42 of the inside portion is the same as the brush of the prior art.

Next, the bonding method of the brushes 42, 43 in the fur brush 32 having the structure described above will be explained with reference to FIGS. 12A and 12B.

Figure 12A:
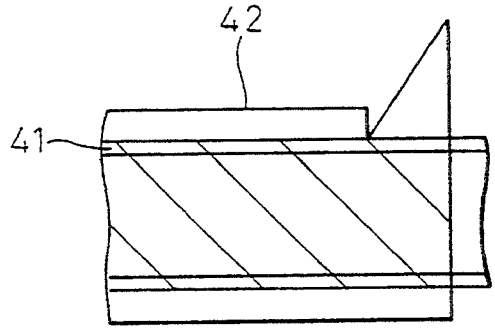
FIG. 12A is an explanatory view showing a fitting method of the fur brush shown in FIG. 10 in the case of an inside portion.
Figure 12B:
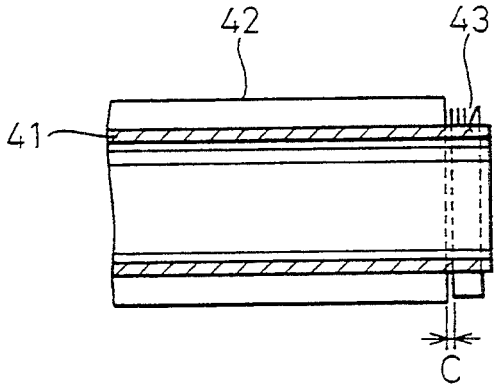
FIG. 12B is also an explanatory view showing the fitting method in the case of an outside portion.

The brush 42 is formed by spirally winding an 80 mm-wide tape substrate, to which fibers of nylon, etc, are implanted, onto the inside portion of the surface of the substrate 41 as shown in FIG. 12A. The fibers have a thickness of 0.02 mm, for example, and is implanted in a density of 11,220 fibers/inch$^2$, for example. The brush 43 is similarly formed by spirally winding a 3 mm-wide tape substrate, to which fibers having different density are implanted, onto the surface of the substrate 41. A gap C of 3 to 5 mm exists at the boundary between the brushes 42 and 43 having different fiber densities. However, no problem will occur because the gap exists outside the print area.

Though, in the later-appearing Experimental Example, nylon was used as the material of the fibers of the brush 42, rayon or other fibers can be used.

Because the cleaning characteristics of the fur brush change between the inside portion and the outside portion as described above, even the fixing toner at the gap producing roller contact portion outside the print area of the photosensitive drum can be cleaned. Therefore, deviation of the gap due to the toner can be eliminated and scattering of the toner does not occur.

Experimental results to evidence this effect (the number of printed sheets and the condition of occurrence of toner filming at gap producing roller contact portion) are illustrated in Table 1 below. Nylon was used as the fiber material. Symbol  represents no filming, and symbol × represents that filming occurred.

TABLE 1

| hair density of outside portion (pcs/inch²) | No. of print thickness (ϕ) and length (mm) of fiber of brush | ⊙ hair material: nylon A4 (printing ratio 4%) start | 100,000 sheets | 200,000 sheets | 300,000 sheets | 400,000 sheets | 500,000 sheets |
|---|---|---|---|---|---|---|---|
| 11,220 (same as inside portion) | ϕ 0.10 × 10 mm | ⊙ | ⊙ | X | — | — | — |
| | ϕ 0.10 × 11 mm | ⊙ | X | — | — | — | — |
| | ϕ 0.10 × 12 mm | X | — | — | — | — | — |
| 12,342 (10% higher than inside portion) | ϕ 0.10 × 10 mm | ⊙ | ⊙ | ⊙ | X | — | — |
| | ϕ 0.10 × 11 mm | ⊙ | ⊙ | X | — | — | — |
| | ϕ 0.10 × 12 mm | ⊙ | X | — | — | — | — |
| 13,464 (20% higher than inside portion) | ϕ 0.10 × 10 mm | ⊙ | ⊙ | X | — | — | — |
| | ϕ 0.10 × 11 mm | ⊙ | X | — | — | — | — |
| | ϕ 0.10 × 12 mm | X | — | — | — | — | — |

⊙: no filming
X: filming occurred

The following can be understood from the results tabulated in Table 1.

(1) The best result can be obtained by increasing the fiber density by 10%.

(2) The shorter the length of the fibers, the better becomes the results (12 mm→10 mm).

The advantages of the present invention are obvious from the Experimental Results given above.

As described above, in the present invention, the cleaning characteristic of the fibers of the fur brush is changed at the outside portion outside the print area of the photosensitive drum to which the toner attaches due to the pressure of the gap producing rollers on the photosensitive drum. Accordingly, the toner can be cleaned, and deviation of the gap resulting from the toner can be eliminated. Scattering of the toner can also be eliminated.

It should be understood by those skilled in the art that the foregoing description relates to only a preferred embodiment of the disclosed invention, and that various changes and modifications may be made to the invention without departing from the spirit and scope thereof.

I claim:

1. An electrophotographic printing apparatus having a cleaning device, said apparatus comprising:

a rotatable photosensitive drum having an outer circumferential surface having, along an axial direction thereof, an inside area including at least a printing area and respective outside areas positioned outward of said inside area in an axial direction thereof; and a rotatable fur brush being in contact with said outer surface of the photosensitive drum entirely in the axial direction of said drum, wherein said fur brush includes, along an axial direction thereof, an inner area opposite to said inside area of the drum and respective outer areas opposite to said respective outside areas of the drum, and a cleaning characteristic of the fur brush in said inner area is different from that in said respective outer areas, and wherein said rotatable fur brush comprises a cylindrical substrate and hairs or fibers implanted on said cylindrical substrate, the hardness of fibers implanted in said outer areas of said fur brush is greater than the hardness of fibers implanted in said inner area of the fur brush.

2. An electrophotographic apparatus as in claim 1, wherein the hardness of the fibers implanted in said outer areas of said fur brush is at least 10% harder than the hardness of the fibers implanted in said inner area of said fur brush.

3. An electrophotographic printing apparatus having a cleaning device, said apparatus comprising:

a rotatable photosensitive drum having an outer circumferential surface having, along an axial direction thereof, an inside area including at least a printing area and respective outside areas positioned outward of said inside area in an axial direction thereof; and a rotatable fur brush being in contact with said outer surface of the photosensitive drum entirely in the axial direction of said drum, wherein said fur brush includes, along an axial direction thereof, an inner area opposite to said inside area of the drum and respective outer areas opposite to said respective outside areas of the drum, and a cleaning characteristic of the fur brush in said inner area is different from that in said respective outer areas, and wherein said rotatable fur brush comprises a cylindrical substrate and hairs or fibers implanted on said cylindrical substrate, the density of fibers implanted in said outer areas of said fur brush is greater than the density of fibers implanted in said inner area of the fur brush.

4. An electrophotographic apparatus as in claim 3, wherein the density of the fibers implanted in said outer areas of said fur brush is at least 10% higher than the density of the fibers implanted in said inner area of said fur brush.

5. An electrophotographic printing apparatus having a cleaning device, said apparatus comprising:

a rotatable photosensitive drum having an outer circumferential surface having, along an axial direction thereof, an inside area including at least a printing area and respective outside areas positioned outward of said inside area in an axial direction thereof; and a rotatable fur brush being in contact with said outer surface of the photosensitive drum entirely in the axial direction of said drum, wherein said fur brush includes, along an axial direction thereof, an inner area opposite to said inside area of the drum and respective outer areas opposite to said respective outside areas of the drum, and a cleaning characteristic of the fur brush in said inner area is different from that in said respective outer areas, and wherein said rotatable fur brush comprises a cylindrical substrate and hairs or fibers implanted on said cylindrical substrate, the hardness of fibers implanted in a part of said outer areas of said fur brush is greater than the hardness of fibers implanted in said inner area of the fur brush and the density of fibers implanted in the remaining part of said outer areas of said fur brush is greater than the density of fibers implanted in said inner area of the fur brush.

6. An electrophotographic apparatus as in claim 5, wherein the hardness of the fibers implanted in said outer areas of said fur brush is at least 10% harder than the hardness of the fibers implanted in said inner area of said fur brush, and wherein the density of the fibers implanted in said outer areas of said fur brush is at least 10% higher than the density of the fibers implanted in said inner area of said fur brush.

7. An electrophotographic apparatus for an electrophotographic printing apparatus comprising:

a rotatable photosensitive drum having an outer circumferential surface having, along an axial direction thereof, an inside area including at least a printing area and respective outside areas positioned outward of said inside area in an axial direction thereof;

means arranged around said rotatable photosensitive drum, said means having a pair of rollers being in contact with said drum at said respective outside areas for defining a certain gap between said means and said outer surface of the drum; and a rotatable fur brush arranged in parallel to said photosensitive drum so as to be in contact with said outer surface of the photosensitive drum entirely in the axial direction of said drum, wherein said fur brush includes, along an axial direction thereof, an inner area opposite to said inside area of the drum, and respective outer areas opposite to said respective outside areas of the drum, and the cleaning characteristic of the fur brush in said inner area is different from that in said respective outer areas, and wherein said rotatable fur brush comprises a cylindrical substrate and hairs or fibers implanted on said cylindrical substrate, the hardness of fibers implanted in said outer areas of said fur brush is greater than the hardness of fibers implanted in said inner area of the fur brush.

8. An electrophotographic apparatus as in claim 7, wherein the hardness of the fibers implanted in said outer areas of said fur brush is at least 10% harder than the hardness of the fibers implanted in said inner area of said fur brush.

9. An electrophotographic apparatus for an electrophotographic printing apparatus comprising:

a rotatable photosensitive drum having an outer circumferential surface having, along an axial direction thereof, an inside area including at least a printing area and respective outside areas positioned outward of said inside area in an axial direction thereof;

means arranged around said rotatable photosensitive drum, said means having a pair of rollers being in contact with said drum at said respective outside areas for defining a certain gap between said means and said outer surface of the drum; and a rotatable fur brush arranged in parallel to said photosensitive drum so as to be in contact with said outer surface of the photosensitive drum entirely in the axial direction of said drum, wherein said fur brush includes, along an axial direction thereof, an inner area opposite to said inside area of the drum, and respective outer areas opposite to said respective outside areas of the drum, and the cleaning characteristic of the fur brush in said inner area is different from that in said respective outer areas, and wherein said rotatable fur brush comprises a cylindrical substrate and hairs or fibers implanted on said cylindrical substrate, the density of fibers implanted in said outer areas of said fur brush is greater than the density of fibers implanted in said inner area of the fur brush.

10. An electrophotographic apparatus as in claim 9, wherein the density of the fibers implanted in said outer areas of said fur brush is at least 10% higher than the density of the fibers implanted in said inner area of said fur brush.

11. An electrophotographic apparatus for an electrophotographic printing apparatus comprising:

a rotatable photosensitive drum having an outer circumferential surface having, along an axial direction thereof, an inside area including at least a printing area and respective outside areas positioned outward of said inside area in an axial direction thereof;

means arranged around said rotatable photosensitive drum, said means having a pair of rollers being in contact with said drum at said respective outside areas for defining a certain gap between said means and said outer surface of the drum; and a rotatable fur brush arranged in parallel to said photosensitive drum so as to be in contact with said outer surface of the photosensitive drum entirely in the axial direction of said drum, wherein said fur brush includes, along an axial direction thereof, an inner area opposite to said inside area of the drum, and respective outer areas opposite to said respective outside areas of the drum, and the cleaning characteristic of the fur brush in said inner area is different from that in said respective outer areas, and wherein said rotatable furbrush comprises a cylindrical substrate and hairs or fibers implanted on said cylindrical substrate, the hardness of fibers implanted in a part of said outer areas of said fur brush is greater than the hardness of fibers implanted in said inner area of the fur brush and the density of fibers implanted in the remaining part of said outer areas of said fur brush is greater than the density of fibers implanted in said inner area of the fur brush.

12. An electrophotographic apparatus as in claim 11, wherein the hardness of the fibers implanted in said outer areas of said fur brush is at least 10% harder than the hardness of the fibers implanted in said inner area of said fur brush, and wherein the density of the fibers implanted in said outer areas of said fur brush is at least 10% higher than the density of the fibers implanted in said inner area of said fur brush.

13. An electrophotographic apparatus for an electrophotographic printing apparatus comprising:

a rotatable photosensitive drum having an outer circumferential surface having, along an axial direction thereof, an inside area including at least a printing area and respective outside areas positioned outward of said inside area in an axial direction thereof;

means arranged around said rotatable photosensitive drum, said means having a pair of rollers being in contact with said drum at said respective outside areas for defining a certain gap between said means and said outer surface of the drum; and a rotatable fur brush arranged in parallel to said photosensitive drum so as to be in contact with said outer surface of the photosensitive drum entirely in the axial direction of said drum, wherein said fur brush includes, along an axial direction thereof, an inner area opposite to said inside area of the drum, and respective outer areas opposite to said respective outside areas of the drum, and the cleaning characteristic of the fur brush in said inner area is different from that in said respective outer areas, and wherein said rotatable fur brush comprises a cylindrical substrate, a fist tape on which first hairs or fibers are implanted, second tapes on which second hairs or fibers, the hardness thereof being greater than that of first fibers, are implanted, and said first and second tapes wound on said inner and outer areas, respectively.

14. An electrophotographic apparatus for an electrophotographic printing apparatus comprising:

a rotatable photosensitive drum having an outer circumferential surface having, along an axial direction thereof, an inside area including at least a printing area and respective outside areas positioned outward of said inside area in an axial direction thereof;

means arranged around said rotatable photosensitive drum, said means having a pair of rollers being in contact with said drum at said respective outside areas for defining a certain gap between said means and said outer surface of the drum; and a rotatable fur brush arranged in parallel to said photosensitive drum so as to be in contact with said outer surface of the photosensitive drum entirely in the axial direction of said drum, wherein said fur brush includes, along an axial direction thereof, an inner area opposite to said inside area of the drum, and respective outer areas opposite to said respective outside areas of the drum, and the cleaning characteristic of the fur brush in said inner area is different from that in said respective outer areas, and wherein said rotatable fur brush comprises a cylindrical substrate, a first tape on which hairs or fibers are implanted, second tapes on which hairs or fibers are implanted so that the density of fibers thereon is greater than that on said first tape, and said first and second tapes wound on said inner and outer areas, respectively.

15. An electrophotographic apparatus as set forth in one of claims 1–14, wherein said rotatable fur brush is driven by a driving source which is different from that of said rotatable photosensitive drum.

16. An electrophotographic apparatus as in one of claims 1–14, wherein said outer areas are areas of said photosensitive drum to which toner is readily adhered to.

17. An electrophotographic printing apparatus having a cleaning device, said apparatus comprising:

a rotatable photosensitive drum having an outer circumferential surface having, along an axial direction thereof, an inside area including at least a printing area and respective outside areas positioned outward of said inside area in an axial direction thereof; and a rotatable fur brush being in contact with said outer surface of the photosensitive drum entirely in the axial direction of said drum, wherein said fur brush includes, along an axial direction thereof, an inner area opposite to said inside area of the drum and respective outer areas opposite to said respective outside areas of the drum, and a cleaning characteristic of the fur brush in said inner area is different from that in said respective outer areas, and wherein cleaning capacities or performance of said respective outside areas are higher or greater than that of said inner area.

18. An electrophotographic apparatus for an electrophotographic printing apparatus comprising:

a rotatable photosensitive drum having an outer circumferential surface having, along an axial direction thereof, an inside area including at least a printing area and respective outside areas positioned outward of said inside area in an axial direction thereof;

means arranged around said rotatable photosensitive drum, said means having a pair of rollers being in contact with said drum at said respective outside areas for defining a certain gap between said means and said outer surface of the drum; and a rotatable fur brush arranged in parallel to said photosensitive drum so as to be in contact with said outer surface of the photosensitive drum entirely in the axial direction of said drum, wherein said fur brush includes, along an axial direction thereof, an inner area opposite to said inside area of the drum, and respective outer areas opposite to said respective outside areas of the drum, and the cleaning characteristic of the fur brush in said inner area is different from that in said respective outer areas, and wherein cleaning capacities or performance of said respective outside areas are higher or greater than that of said inner area.

* * * * *